US005913454A

United States Patent [19]

McHale

[11] Patent Number: 5,913,454

[45] Date of Patent: Jun. 22, 1999

[54] DRINK DISPENSING MACHINE

[76] Inventor: Jay T. McHale, 1248 Atlantic Dr., Atlanta, Ga. 30318

[21] Appl. No.: 09/057,885

[22] Filed: Apr. 9, 1998

[51] Int. Cl.[6] ..... B67D 5/10

[52] U.S. Cl. ..... 222/2; 40/407; 222/23; 222/64; 222/113; 222/146.6; 235/381; 362/96

[58] Field of Search ..... 222/2, 146.6, 113, 222/64–66, 23, 14, 30, 36–38; 40/331, 332, 547, 406, 407; 362/32, 96, 101, 253, 806; 194/210; 364/479.01, 479.02, 479.1, 479.11, 479.12, 479.14

[56] References Cited

U.S. PATENT DOCUMENTS

| | | | |
|---|---|---|---|
| 4,106,671 | 8/1978 | Sharples | 222/64 X |
| 4,406,382 | 9/1983 | Roth | 222/64 |
| 5,007,560 | 4/1991 | Sassak | 222/2 X |
| 5,133,480 | 7/1992 | Matsumoto et al. | 222/2 |
| 5,198,976 | 3/1993 | Form et al. . | |
| 5,291,004 | 3/1994 | Frank et al. | 235/381 |
| 5,383,574 | 1/1995 | Raphael | 222/64 X |
| 5,513,775 | 5/1996 | Sizemore | 222/2 |
| 5,730,330 | 3/1998 | Reading | 222/113 |
| 5,769,271 | 6/1998 | Miller | 222/2 X |

*Primary Examiner*—Kevin P. Shaver
*Attorney, Agent, or Firm*—Henderson & Sturm

[57] ABSTRACT

A controlled self-service drink dispensing machine including a refrigerated piping network for transporting beverages, such as wine and beer, from a central location to a plurality of remote dispensing consoles. A centrally located bartender terminal is electronically coupled to each of the remote dispensing consoles which are activated by magnetic credit/debit cards received in the remote consoles. A beverage transparent plastic delivery tube in each remote console is bracketed by a light emitting diode transmitter and receiver system that is electronically coupled to the bartender terminal to alert the bartender of a low keg by sensing the amount of air and/or bubbles flowing through the delivery tube.

9 Claims, 6 Drawing Sheets

DRINK DISPENSING MACHINE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of beverage distribution, and more particularly to a computerized remote beverage distribution machine.

2. Description of Related Art

As can be seen by reference to the following U.S. Pat. Nos. 5,133,480; 5,198,976; 5,291,004; and 5,513,775, the prior art is replete with myriad and diverse drink dispensing machines.

While all of the aforementioned prior art constructions are more than adequate for the basic purpose and function for which they have been specifically designed, they are uniformly deficient with respect to their failure to provide a simple, efficient, and practical drink dispensing machine.

As a consequence of the foregoing situation, there has existed a longstanding need for a new and improved drink dispensing machine and the provision of such a construction is a stated objective of the present invention.

BRIEF SUMMARY OF THE INVENTION

Briefly stated, the present invention provides a controlled self-service drink dispensing machine including a refrigerated piping network for transporting beverages, such as wine and beer, from a central location to a plurality of remote dispensing consoles. A centrally located bartender terminal is electronically coupled to each of the remote dispensing consoles which are activated by magnetic credit/debit cards received in the remote consoles. A beverage transparent plastic delivery tube in each remote console is bracketed by a light emitting diode transmitter and receiver system that is electronically coupled to the bartender terminal to alert the bartender of a low keg by sensing the amount of air and/or bubbles flowing through the delivery tube.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
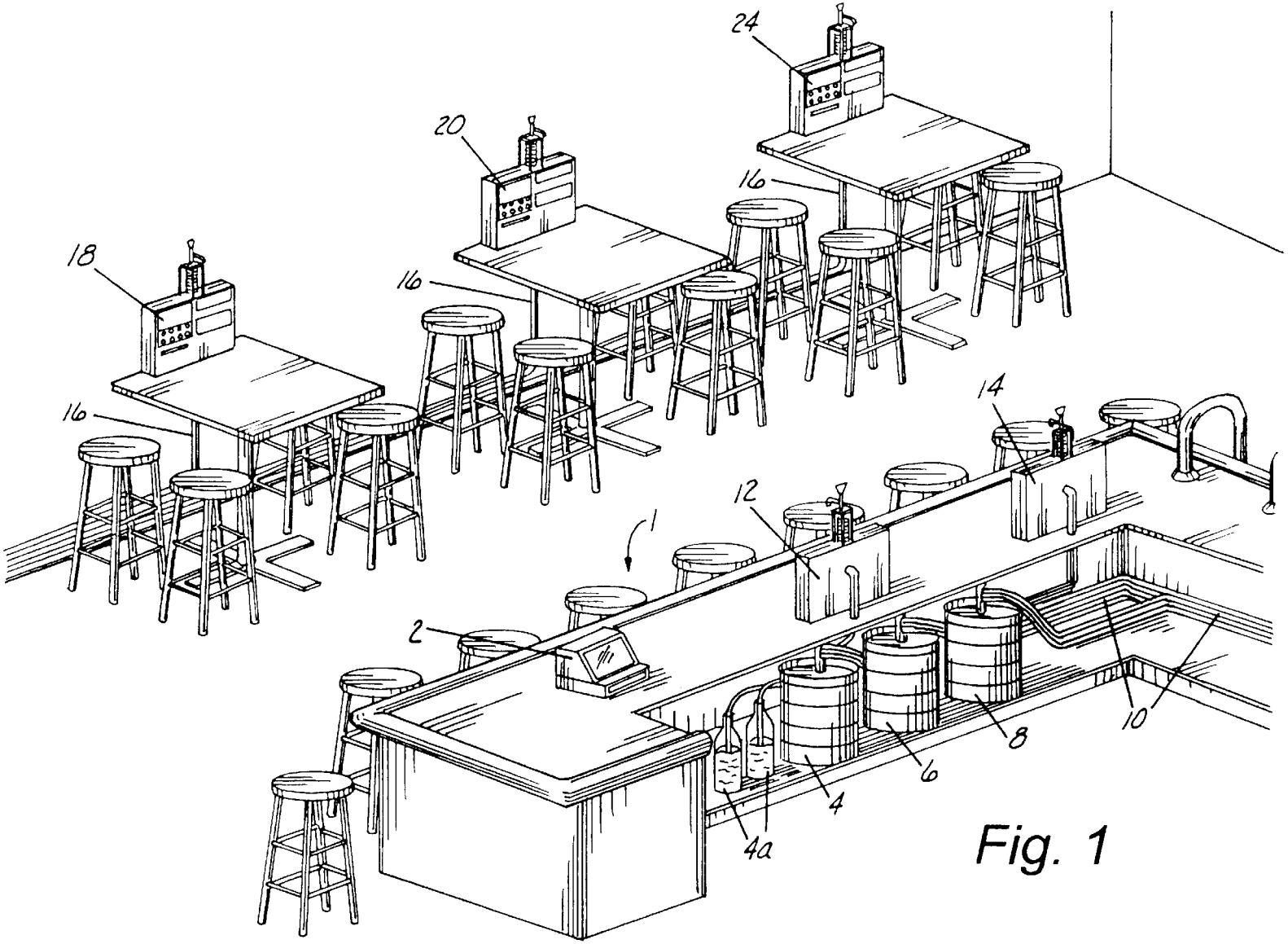
FIG. 1 is a perspective view showing the drink dispensing machine of the present invention installed at the bar and tables of a lounge.

As can be seen by reference to the drawings, and in particularly to FIG. 1, the drink dispensing machine that forms the basis of the present invention is designated generally by the reference number 1. The drink dispensing machine 1 is a creative new product which has the unique capability of allowing customers to purchase beer or wine via credit/debit cards at their table without having to go to the bartender.

Referring to FIG. 1, which provides the general overview of the drink dispensing machine, the computer terminal/register has fixtures or attachments which allows attachment of the following parts: the beer keg for brand A, the wine bottle 4*a*, the beer keg for brand B, the beer keg for brand C, the stainless steel, insulated dispensing lines 10, the customer dispensing console 1, bar location 12, the customer dispensing console 2, bar location 14, the stainless steel dispensing lines routed to tables 16, the customer dispensing console 3, table location 18, the customer dispensing console 4, table location 20, and the customer dispensing console 5, table location 22.

Figure 2:
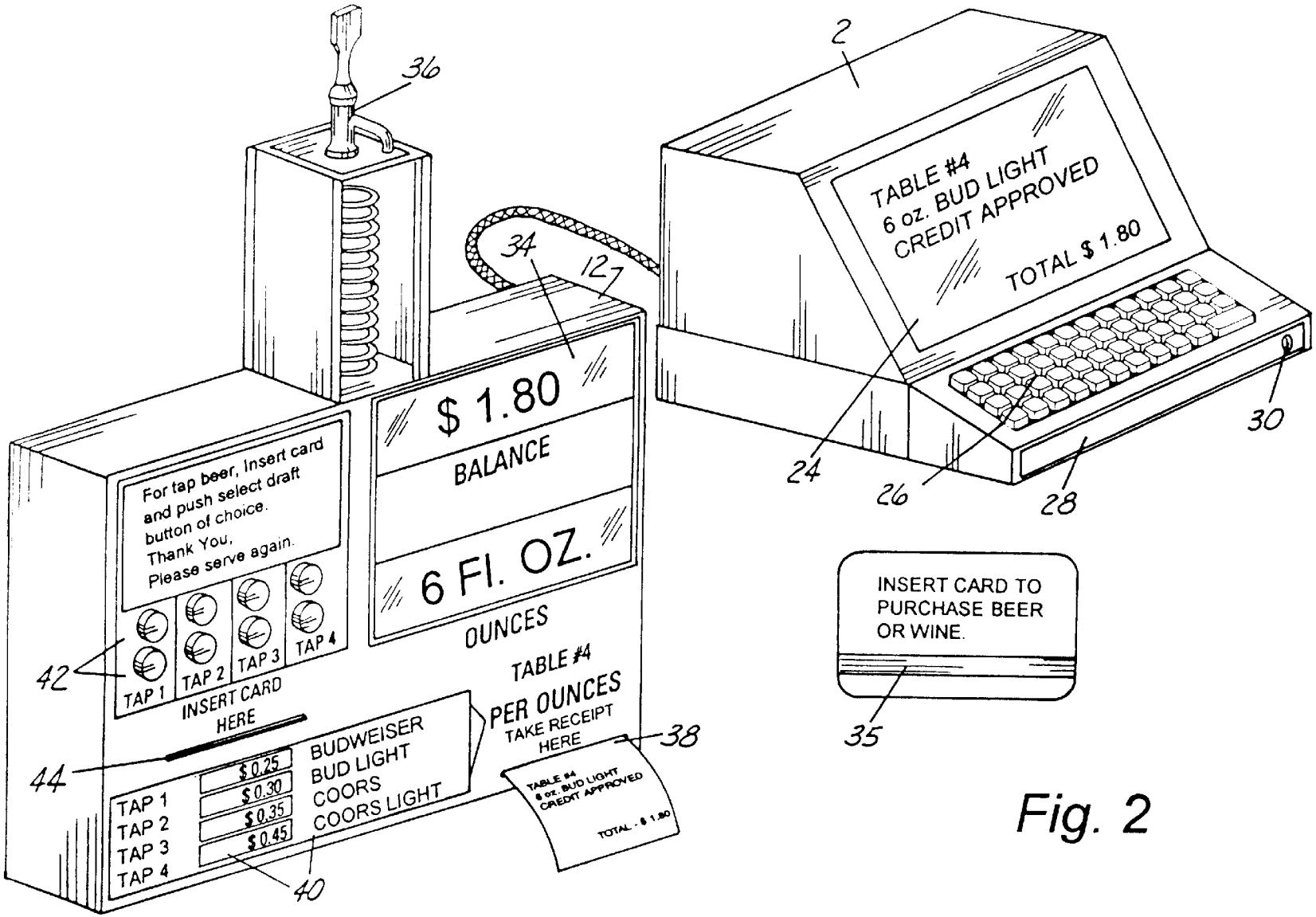
FIG. 2 is a perspective view showing the central bartender terminal connected to one of the customer dispensing consoles.

FIG. 2 further illustrates in detail the technical relationship of the base frame computer terminal/register 2, and the liquid crystal display 24, the keyboard 26, the cash drawer 28, the key lock, cash drawer 30, the customer controlled dispensing console 12, the liquid crystal information display, customer console 34, the credit/debit card 35, the dispensing tat 36, the customer receipt, card printout 38, the liquid crystal display, liquor price per ounce 40, the beer wind/availability indicators (LED's) 42, and the credit/debit card input slot 44.

Advantages of the drink dispensing machine include the following. Customers have the excitement and convenience of filling their own beer or wine refreshment. Less waitresses and waiters labor requires, resulting in increased profits. A pre-paid debit type card 35 is utilized that has the bar name/logo printed on it which provides free word-of-mouth advertising. Use of this type card saves labor at the bar as well. If money pre-paid on the card is not used due to the customer not returning, the remaining balance is considered profit. Reduction of employee theft (shrinkage). Control of customer alcohol intake via computer monitoring alerts the bartender.

The design of the drink dispensing machine 1 includes a customer controlled terminal 12, 14, 18, 20, 22, that provides the dispensing of selected brands of beer or wine at the table, and more particularly relates to a customer console which communicates with a bartender-controlled computer terminal/register 2 located behind the bar area. The machine 1 prevents the bartender from constantly refilling drinks, while also providing the customer with an easier way to get a fresh beer.

The machine 1 also provides an automated credit/debit card transaction at the table while inside the bar, speeding up sale transactions of liquor, beer or wine, while also allowing customers to not rely on a server, providing quicker service in obtaining their beer.

The machine 1 includes a centrally located computer terminal/register 2 that monitors at least one, and preferably, many beer dispensers 12, 14, 18, 20, 22 for selective retrieval of beer sales information. The sale information collected and processed by the main computer 2 includes the amount of beer remaining in a keg, the amount of beer consumed at each table, the amount of beer consumed at each table per card, the amount of beer consume at each table per hour, computer control of each table, on or off, and the price per ounce of the beer (changeable price per ounce by the bartender or bar owner). The central computer 2 communicates with the bartender permitting the bartender to selectively activate any one or all of the beer dispensing kegs, as well as one or more large bottles of wine. A remote customer controlled electronic console 12, 14, 18, 20, 22, located at the bar or table, works in conjunction with the associated beer dispensing keg 4, 6, 8, or wine bottle 4*a*, and communicates with the central terminal 2 in order to permit a customer to provide collateral by way of credit/debit card 35. This action enables the selected keg by the customer at a location remote from the central computer terminal/register 2. The customer-controlled console includes a credit/debit card reader which obtains credit/debit card information via the central computer/modem in order to verify the credit/debit status of the card the customer is using for collateral. A push-button control and display device is included on the customer console that permits the customer to select an individual brand of beer by activating the keg for that brand of beer.

Figure 4:
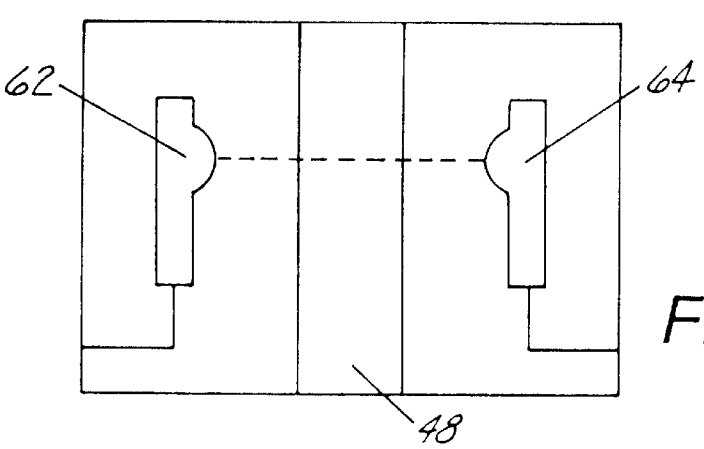
FIG. 4 is a schematic showing the sensor assembly.
Figure 5:
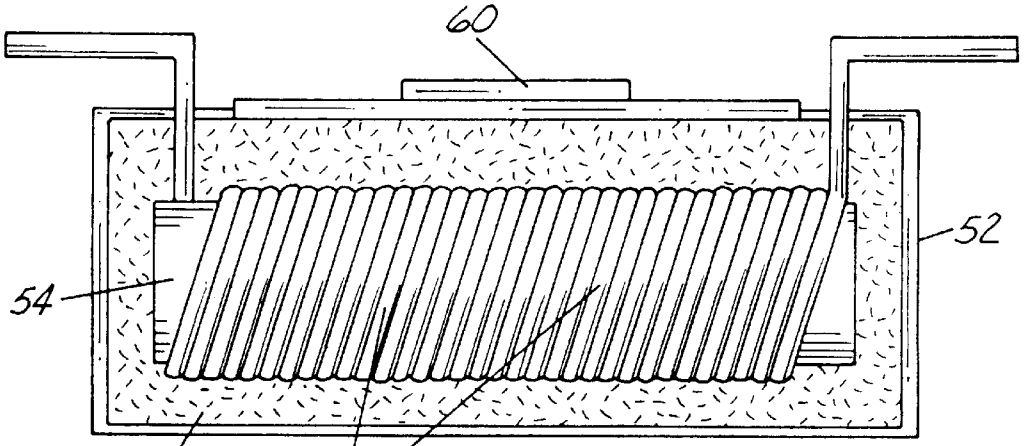
FIG. 5 is a front elevational sectional view of the beverage chill station.
Figure 3:
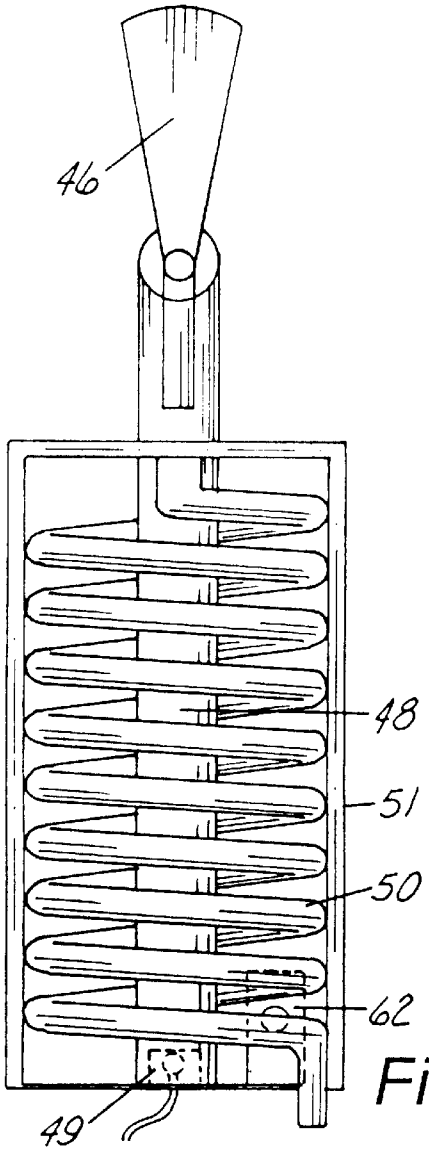
FIG. 3 is a front elevational view of the dispenser.

To one side of the central computer 2 a series of beer taps one for each beer keg serve to prime the "head" out of each keg and prepare the beer inside the keg for a patron's consumption. As best shown in FIG. 4, the counter-mounted beer taps 46 are of standard pull down design and incorporate a center rod 48 of clear plastic leading directly from the tap and being illuminated by a bulb 49. The taps also have the ability to dispense wine. Surrounding the illuminated rod 48 is a length of clear plastic tubing 50 coiled along the rod surface. Both the rod 48 and tubing 50 are sheathed in a broad tube of transparent plastic 51. Leading from the top of each individual keg is a line connecting the keg and counter mounted taps to a dispensing station mounted on each patron's table. Located along the midpoint of each line a rectangular container 52 made from foam insulation serves to insulate a length of pipe 54 made from stainless steel over which the beer or wine line 56 is wrapped. A layer of crushed ice 58 fills the container 52 and may be refilled by opening a top mounted lid 60 to gain access to the inside contents. Each beer keg or bottle has a corresponding table mounted tap utilizing a design similar to the one incorporated in the counter mounted taps and an overhanging spigot style dispenser. Along one point of the feed line 50 surrounding the illuminated clear plastic rod 48, the table mounted taps would utilize a light emitting diode (LED) transmitter 62 and receiver 64 system which is wired to the central computer 2 and serves to alert the bartender of a low keg by measuring the amount of air and/or bubbles flowing through the tube 50.

The machine 1 includes a number of beer dispensing kegs, each having several separate beer dispensing lines to allow variety for different brands and types of beer. The machine 1 consists of a bartender-controlled computer terminal/register positioned behind the bar, and a customer-controlled console either located at individual tables or in locations at the bar. A twisted pair cable which runs below the bar to the individual stations provides digital communication between the console and the customer-controlled console. A second cable connects the console to the telephone line modem connection to the credit card company for transmission and receipt of credit/debit card information.

The bartender-controlled computer terminal/register 2 of the machine 1 includes a receipt printer, a credit/debit card reader, a keyboard, and a visual display and keg control keyboard area. As mentioned, the bartender who may take cash or credit/debit cards for payment of beer dispensed from the kegs controls the console the customer-controlled console includes a credit/debit card reader, a push button, and a liquid crystal visual display. The customer controls the console in order to enable a selected brand of beer, which activates the valve for that keg of beer. The customer pulls or swipes his credit/debit card through the credit/debit card reader in order to provide collateral for dispensing the selected beer. The particular keg or brand of beer that the customer desires is activated by being keyed into the customer-controlled console by the customer.

The liquid crystal display device provides various visual communication instructions to the customer in order to aid him to properly activate and pay for a selected beer keg or wine bottle. In addition to the conventional credit/debit card, a customer may also purchase a card at the bar that allows money credits to be applied to the card. The customer simply pays the bartender money and that dollar amount is applied to the "in house" debit card. This addition to the system allows customers that do not own credit or debit cards to utilize the system effectively.

Each of the several customer controlled consoles communicates with the bartender's main computer console/register in order to provide keg activation via a computer controlled valve system. The console serves to control the actual keg activation and credit/debit authorization, as well as instructing customers at the dispenser during the keg activation process. The customer is guided through the use of the console by a series of prompting messages displayed on a display screen before beer is accurately dispensed by the ounce. A series of red and green prompting lights will also assist in directing the customer. When in use, the customer will swipe his credit/debit card through the reader, and the card numbers will be conveyed to the bartender's computer console/register.

There the credit/debit card numbers are transmitted in a normal fashion via modem by the computer to the card authorization/verification service center as is conventionally done with all cards. If credit/debit approval is given by the service, usually a quick event, a set of red LED's which indicate that none of the taps will work will turn green, indicating to the customer final acceptance of their card. Included is further information for the customer providing instructions on the display screen to select a dispenser keg, type and brand of beer or wine desired, by using the provided push button console. His selection will be indicated to the bartender by indication in the display area of the bartender's console the bartender then will manually authorize the selected beer keg via the bartender's console. The bartender or bar owner has the capability to bypass this feature, allowing the customer to automatically enable the appropriate beer dispensing keg when properly selected by the customer. However, the interplay of the bartender in the activation process keeps the bartender appraised of active kegs for his subsequent completion of the sale. Automatic operation via the computer terminal is considered to be normal however.

The communication link between the customer's console and the bartender's computer/register is provided by means of conventional serial port, which includes a transmit cable and a receive cable. During conventional operation or idling mode, the customer console will display "INSERT CARD" in conjunction with a set of red LED's. A flashing arrow pointing to the card reader may also be included in the message. Once the customer has successfully swiped his credit/debit card through the reader, the display will read "CHECKING CREDIT" as the card number is sent to the bartender's console for credit/debit authorization. Where credit/debit is denied, a message will appear on the customer console display, as for example "INVALID CARD", "DENIED", or "CARD EXPIRED". Cards which have been stolen and require the intervention of the bartender will cause a "SEE BARTENDER OR MANAGER" to be displayed on the display device. Where a card cannot be read after three attempts, the display device will read "SEE BARTENDER OR MANAGER".

When credit/debit authorization has been obtained by the bartender's console, the display on the customer console will say "CREDIT OK" and "MAKE BEER OR WINE SELECTION". The red LED's will turn to a green color also providing visual acceptance of the card. The customer would then use the keyboard to select a brand of beer or wine. The bartender then enables the customer's selected beer keg for dispensing beer.

When a keg or bottle has been properly selected and activated, and the handle for that table dispenser is actuated, the bartender's computer terminal/register receives an indication of handle actuation and will reset, return to idle, while the display at the customer console will return to "INSERT CARD" with associated red LED's lit, indicating that the next customer may begin his transaction.

Failure to actuate the keg handle of the selected beer keg within a predetermined number of seconds, for example, thirty seconds after a message first appears, will cause the entire transaction to be canceled. The keg will be de-authorized, the credit/debit card number will be erased from the console, and the customer's console will return to the "INSERT CARD" message with red LED's lit.

The credit/debit card reader includes a conventional magnetic card receiving slot adapted to receive the customer's credit/debit card in a sliding in-out fashion as the customer inserts the card. A reading head (not shown) positioned along the insides of the guide slot generates a signal having the information carried magnetically by the card as the card is pulled quickly through the slot. The card reader retrieves the information from the card for commanding automatic investigation by the bartender's console of the credit/debit status of the particular credit/debit card read.

A receipt may then be printed from a printer, activated by a sale at the table through use of the card. The selected keg is reset by subsequent actuation of the button on the upper row of the keypad, when re-enabling the keg for the next customer. The printer may be of the conventional dot matrix type of the alphanumeric variety. Ordinarily, the printer prints individual customer receipts at the table where payment is made by way of the credit/debit card. The printer is conventional in nature and prints a receipt for the customer containing usual purchase information. The bartender located terminal/register is capable of printing out particular creditdebit card number of customer sales, including the total sale amount for the register.

A conventional personal computer (PC) controls the overall system processing and management of the table located consoles. The PC performs a number of tasks that may be summarized as follows. Data is retrieved from the dispensing kegs in the form of a measure of the value amount of the beer dispensed and is manipulated by the PC to enable printing of beer sale information by a printer. Credit/debit card data read from the customer's credit/debit card from the card reader is manipulated to provide output commands along the running cable for enabling transmission of the credit/debit card information to a data bank for establishing credit/debit authorization. Data is retrieved from and transmitted to the customer controlled console in order to provide instructions to a customer during customer activation of a selected one of the beer dispensing kegs. The PC treats the printer, card reader, keyboard, display area, beer dispensing kegs, and customer consoles as peripheral devices which are interconnected by means of conventional bus cables. The PC is also connected to the telephone line for communication with the credit card authorization service.

The PC is interconnected to the dispensing consoles via wire cable for monitoring the sale of beer or wine dispensed from each keg and for monitoring the actuation of the keg handle when the customer begins to dispense beer. Also, the dispensing kegs receive commands from the PC for activation and resetting of the selected kegs. The final totals for each keg are kept track of with in the PC at the completion of beer dispensing when commanded by the bartender's actuation of the dispenser control keypad. The PC performs a number of tasks that may be summarized as follows. Data is retrieved from the card reader of the information read from the customer's credit/debit card and is manipulated to provide output commands via an output cable to an input port of the PC of the bartender's console. Data is retrieved from the keyboard of the particular keg selected by the customer and is manipulated to provide output commands along the wire or cable via an output port to the bartender's console. Data is received from the bartender's console via an output of particular instructional commands for causing display of information to the customer and is manipulated to provide output commands to the display device for displaying visual instructions to the customer operated console.

Figure 6:
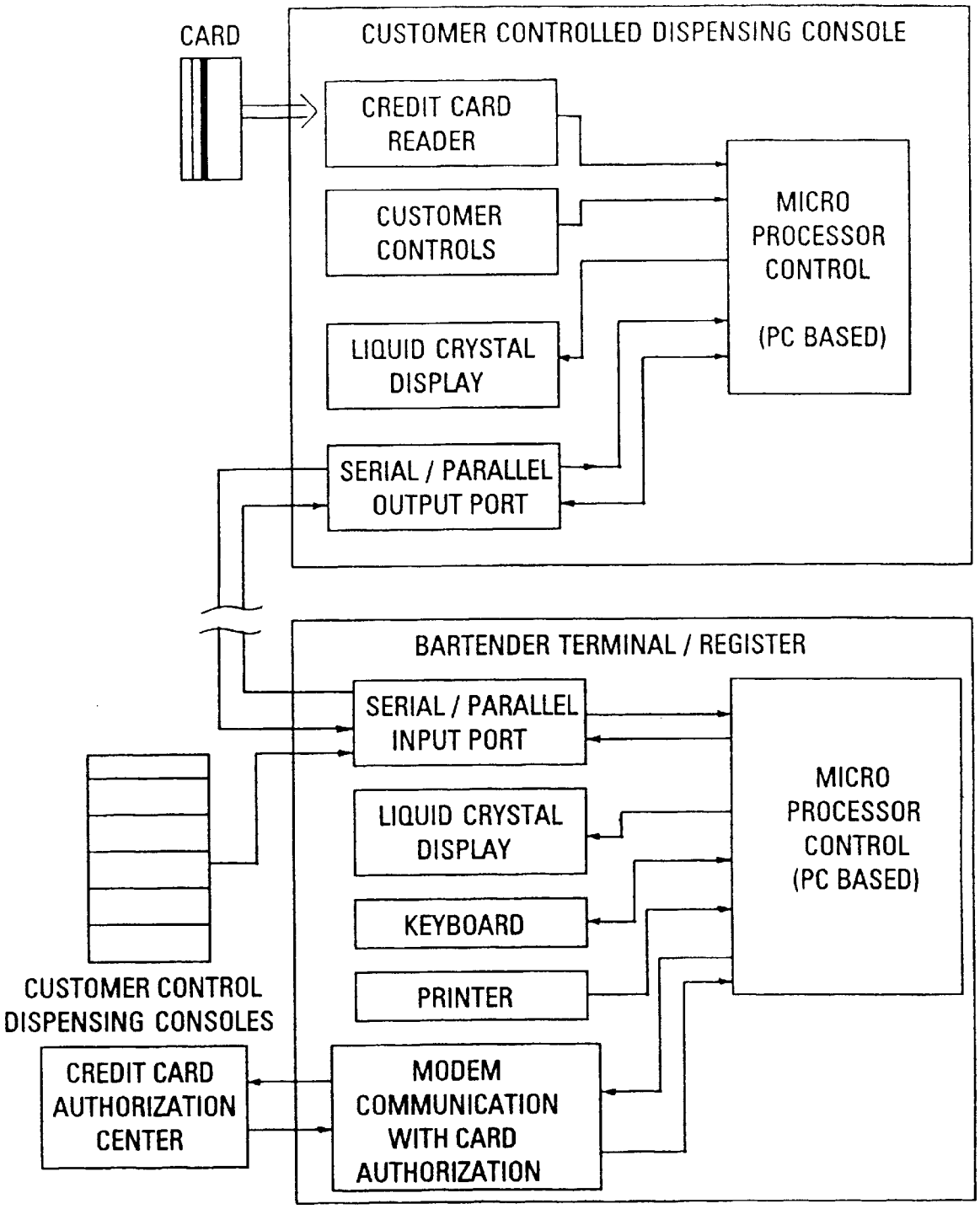
FIG. 6 is a schematic showing the bartender terminal and the customer dispensing console.

The PC treats the credit/debit card reader, keyboard, display device, and output port as peripheral devices that are interconnected by means of a conventional wire bus or cables. The PC may include a conventional 8 or 16 bit parallel bus microprocessor, Pentium based, which would normally have an accumulator, a plurality of registers, and an instruction register included CPU control for interpretation and execution of micro-level assembly language instructions. The PC manages the acquisition of dispensing sales data from beer kegs and other sales information data entered through keyboard, processes the data and prints the sale information under the control of the keyboard permitting the bartender to initiate particular operations to be performed by the PC. In order to provide a keg activation request to the bartender by a customer using the customer console, the PC software steps through a control sequence of steps diagrammatically shown in the flow charges illustrated in FIGS. 6 and 7. The control sequence for the customer console embodies a set of subroutines utilized to transmit and read information from the bartender's console, read information from the card reader and from the keyboard and transmit information to the display device.

Figure 7A:
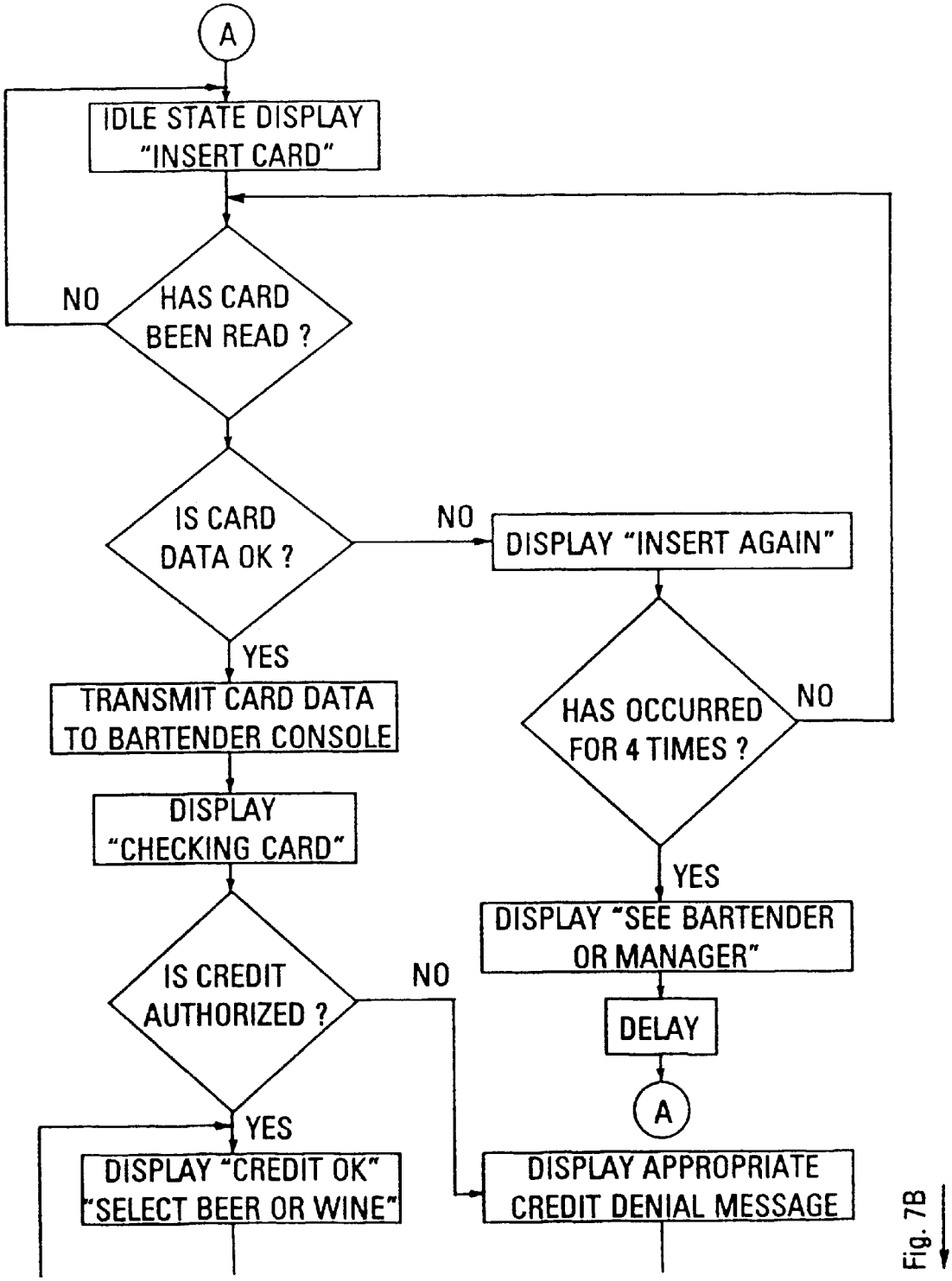
FIG. 7 is a schematic showing the operation of the drink dispensing machine.
Figure 7B:
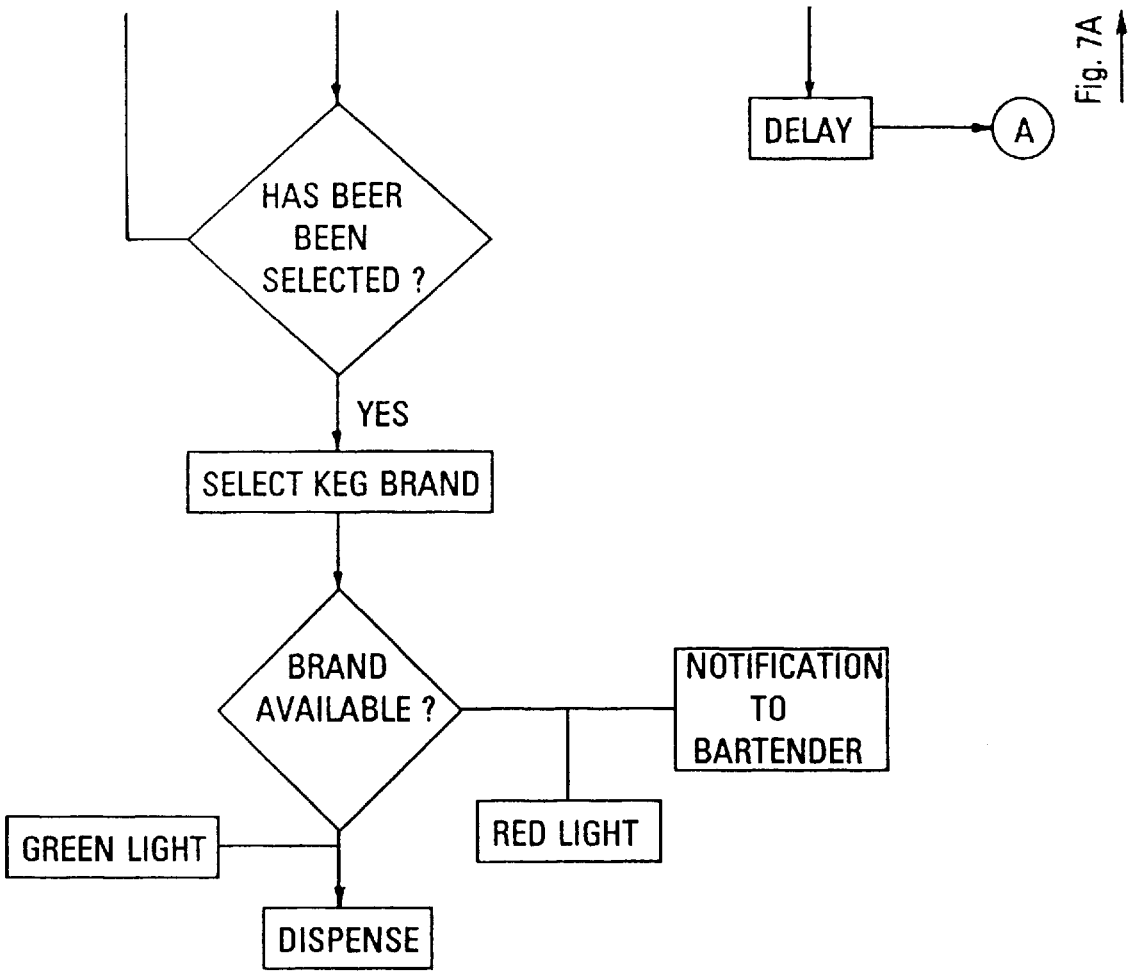

Referring to FIG. 7, the encircled A at the top of the illustration indicates the initial entry point into the control sequence for execution of a keg activation request from the customer's console to the bartender's console. The PC transmits display signals to the display device to display "INSERT CARD". This display is maintained by the PC until activation of the console by a customer. This is the idle state of the customer console. The customer console is placed in its idle state by a reset instruction from the bartender's control console.

The PC determines whether a credit/debit card has been pulled through the customer console in order to begin the process of keg activation. So long as a credit/debit card has not been read, the customer control console stays in its ideal state. Upon the actuation of the credit/debit card reader, the PC is signaled for retrieving the entire card data to be received. This may be accomplished by an interrupt signal from the card reader.

The PC based terminal/register may perform a number of checks to determine whether the entire card data has been retrieved, similar to the card check performed by the PC. If the credit/debit card information is incomplete, the PC based terminal/register may display a "INSERT AGAIN" on the display device for signaling the customer to reenter the credit/debit card through the card reader. If this occurs after four times in a row, the PC based terminal/register may display "SEE BARTENDER OR MANAGER" on the display device to instruct the customer to see the bartender regarding the non-reading of the credit/debit card. Either PC based terminal/register system may perform the step of checking the card data. Other checks may be performed for invalid or expired cards.

Where the PC based terminal/register receives the entire card data, it manipulates the data for transmission to the console and then activates the display device for displaying "CHECKING CARD" to the customer console. After the data has been received by the PC from the console, the PC enters its subroutine for transmission of the credit/debit card data to the bank. After data transmission, the PC awaits credit/debit authorization or denial to be returned from the credit card authorization center via modem. The credit card authorization center functions by returning to the PC a credit/debit card validation data set that is indicative of the credit/debit card validity state.

The bartender's computer terminal/register reads the data transmitted from the credit card authorization center and determines whether or not credit/debit has been authorized. Depending on whether or not credit/debit has been authorized, a particular display is to be shown on the display device to the customer. If credit/debit is authorized, the display will read "CREDIT OK", "SELECT BEER OR WINE SELECTION". The PC based terminal/register provides instructions to the PC for displaying the proper information to the customer. The PC based terminal/register stores the credit/debit card information.

The customer's PC based console responds to instructions from the bartender's PC based terminal/register as to whether credit/debit has been authorized. If credit/debit has not been authorized, a message "SEE BARTENDER OR MANAGER" is displayed on the customer's console LCD display device for a predetermined time. Thereafter, the customer's PC based console enters its idle state for use by a new customer.

If credit/debit has been authorized at this point, the customer's PC based console displays "CREDIT/DEBIT OK", "SELECT BEER BRAND" and awaits the selection of the keg number, desired beer brand/type by the customer. The customer's PC based console then determines which of the several keys of the keyboard have been actuated and then forward the information to the bartender's PC based terminal/register.

The bartender's PC based terminal/register upon receiving the keg request number searches its memory to determine whether or not the keg is available for actuation. If the keg is available for activation, the bartender's PC based terminal/register sends instructions to the customer's console, which are interpreted for actuation of the display device to display "POUR BEER". The bartender's PC based terminal/register also actuates a flashing of the appropriate button on the display area for signaling the bartender that a particular keg being selected by the customer is low and requires replacement.

The lines that carry beer or wine should be carried from the containers to the table dispensers in "foam-insulated" stainless steel tubing. The PC and the associated circuit boards used to control the system is of the off the shelf type using a Pentium type microprocessor for maximum computer power. Modem communication to the credit/debit card authorization site is built into the PC. All other communication to the remote dispensers located at the tables is performed through serial or parallel communication ports commonly found on PC. The solenoid valves for computer controlled dispensing of beer and wine is also available. The customer controlled console chassis may be manufactured of stamped stainless steel or injection molded ABS plastic.

The case chassis assemblies of the machine 1 would be best manufactured using the plastic injection molding process. Injection molding is a plastic molding procedure whereby heat softened plastic material is forced under very high pressure into a metal cavity mold which is relatively cool. Acceptable metals for the mold are aluminum and steel. The inside cavity of the mold is comprised of two or more halves, and is the same desired shape as the product to be formed in this instance the case/chassis components of the machine 1. High pressure hydraulics are used to keep the mold components together during the actual injection phase of the molding process. The injected plastic is allowed to cool and harden.

The hydraulics holding the multiple component cavity together are released, the halves of the mold separated and the solid formed plastic item is removed. Injection molding can be a highly automated process and is capable of producing extremely detailed parts at a very cost effective price. This process should be invaluable for producing the machine 1 cost effectively.

The electronics of the machine 1 are manufactured using fiberglass printed circuit boards using a combination of conventional and surface mount electronic components. Surface mount components are much smaller than conventional electronic components, but perform the same electrical function. Components, once installed either by hand or robots, are mass soldered to the printed circuit board using the preferred drag soldering process.

Drag soldering is a process of mass soldering electronic circuit board assemblies. The circuit boards loaded with electronic components to be soldered are placed on an automated transport carrier. The carrier transports the circuit boards through a series of fluxing cleaning and preheat stations before finally lowering the circuit boards into a molten vat of tin/lead solder. All of the components are soldered at one time in this procedure, creating solid solder joints in one rapid process.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A drink dispensing machine comprising:

a piping network interconnecting a central beverage container and a plurality of remote dispensing consoles;

a centrally located bartender terminal electronically coupled to each of the remote dispensing consoles;

a magnetic card adapted to be read by each dispensing console, the magnetic card being selectively programmed to activate a beverage dispensing valve on the console;

a transparent delivery tube disposed in fluid communication between the beverage container and dispensing valve; and a light emitting diode transmitter and receiver system disposed on opposite sides of the transparent tube, the transmitter and receive system being electronically coupled to the bartender terminal, wherein air flowing through the delivery tube is sensed by the transmitter and receiver system and a signal is generated to alert the bartender of a low beverage supply in the container.

2. The drink dispensing machine of clam 1 wherein the piping network is refrigerated.

3. The drink dispensing machine of claim 1 wherein the beverage is beer.

4. The drink dispensing machine of claim 1 wherein the beverage is wine.

5. The drink dispensing machine of claim 1 wherein a plurality of central beverage containers are connected to the piping network.

6. The drink dispensing machine of claim 1 wherein the transparent delivery tube is formed of plastic.

7. The drink dispensing machine of claim 6 wherein the delivery tube is located in the dispensing console.

8. The drink dispensing machine of claim 7 wherein the delivery tube is coiled.

9. The drink dispensing machine of claim 8 further including an illuminated rod around which the delivery tube is coiled.

* * * * *